United States Patent [19]

Korany et al.

[11] 4,196,545

[45] Apr. 8, 1980

[54] WINDOW STRUCTURE

[75] Inventors: Zoltan Korany, 2009 Donelson La., Salt Lake City, Utah 84117; LeRoy C. Fuller, 2154 E. 7420 South, Salt Lake City, Utah 84121

[73] Assignees: Pauline L. Fuller; LeRoy C. Fuller; Elizabeth Fuller Korany; Zoltan Korany, all of Salt Lake City, Utah

[21] Appl. No.: 900,751

[22] Filed: Apr. 27, 1978

[51] Int. Cl.[2] ..... E06B 3/32; E06B 3/54

[52] U.S. Cl. ..... 49/463; 49/62; 160/376

[58] Field of Search ..... 160/374–376; 49/55, 57, 61, 67, 463, 62

[56] References Cited

U.S. PATENT DOCUMENTS

| | | | |
|---|---|---|---|
| 2,555,138 | 5/1951 | Knorr | 160/376 X |
| 2,593,258 | 4/1952 | Breuer | 160/376 X |
| 2,597,484 | 5/1952 | Helig | 160/376 X |

*Primary Examiner*—Kenneth Downey

*Attorney, Agent, or Firm*—Thorpe, North & Gold

[57] ABSTRACT

A window structure adapted for easy placement in and removal from a conventional window frame. The window structure includes a generally planar, rectangular window pane constructed of glass, acrylic resin, or the like. Also included are four frame members, each having a slot extending longitudinally therein to receive the edge of the window pane. Two of the frame members are dimensioned for placement on the top and bottom edge of the window pane and the other two frame members are dimensioned for placement on either side edge of the window pane. An elongate, wire element formed with a plurality of bends is placed in the slot of each frame member to bias the frame member away from the edge of the window pane and against periphery defining walls of the window frame to securely hold the window structure therein. The window pane includes four apertures each located near a different edge of the pane about midway along the lengths thereof. A pivot pin is insertable through each frame member and through a corresponding one of the apertures to serve as a pivot for the frame members. Such pivoting enables varying the perimeter dimensions of the window structure to accommodate variations in window frame shapes into which the window structure might be placed.

10 Claims, 3 Drawing Figures

FIG. 1
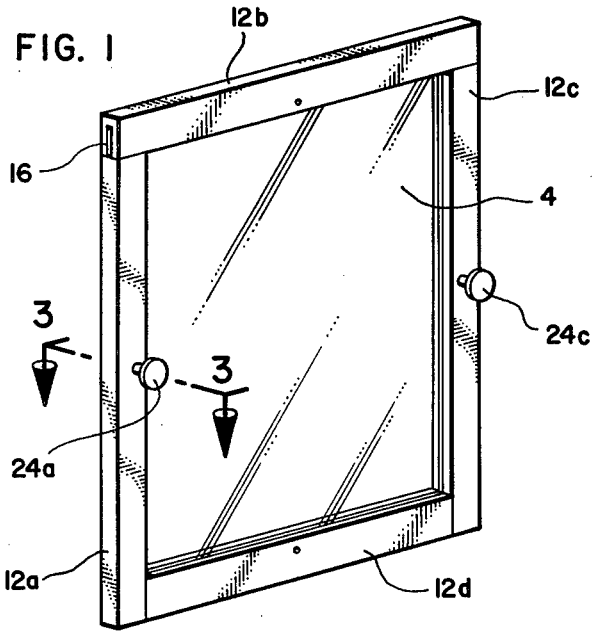
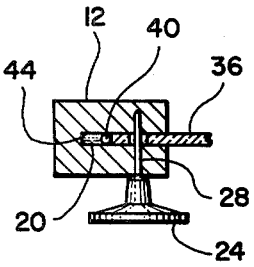
FIG. 3
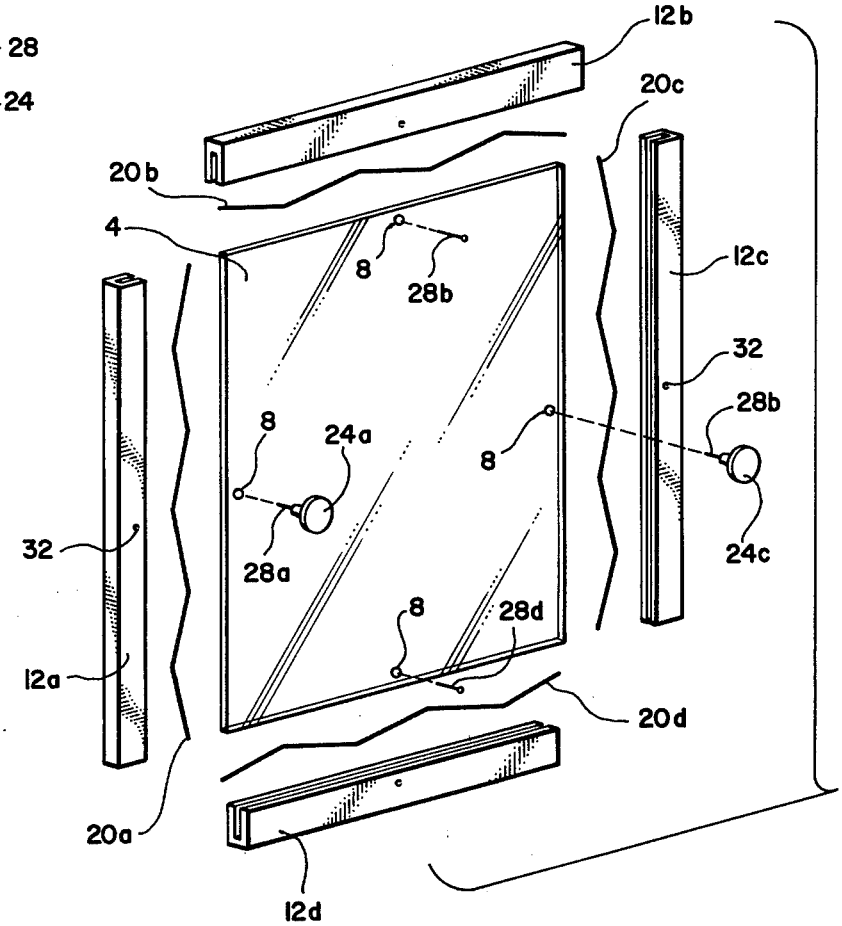
FIG. 2

WINDOW STRUCTURE

BACKGROUND OF THE INVENTION

The present invention relates to a window structure adapted for easy installation in and removal from a conventional window frame.

The use of storm windows and double pane windows for improving insulation between the interior and exterior of a house has been common for some time. Provision of a window construction having two panes of glass with an air pocket between the panes is recognized as an effective way to insulate. Storm windows, however, are generally quite expensive and difficult to install, oftentimes requiring a professional installer. Although double pane windows typically require little more work to install than a single pane window, the two panes cannot later be separated and the cost of such double pane windows is quite high.

SUMMARY OF THE INVENTION

It is an object of the present invention to provide a window structure which enables easy insertion into and removal from a conventional window frame.

It is still another object of the invention to provide a window structure which may be press fitted into a conventional window frame.

It is still another object of the invention to provide a window structure whose exterior dimensions are variable to a certain extent to accommodate dimension variations in window frames into which the window structure might be placed.

It is a further object of the present invention to provide a simple, inexpensive and easy to construct window frame structure suitable for removable installation in a conventional window frame.

The above and other objects of the invention are realized in a specific illustrative embodiment thereof which includes a generally planar window pane, a plurality of frame members, each having slots therein for receiving a portion of the edge of the window pane to enable positioning the frame members about the edge of the window pane, and spring biasing elements disposed in the slots for contacting the edge of the window pane to urge the frame members outwardly from the window pane into contact with periphery defining walls of a window frame into which the window structure is placed.

In accordance with one aspect of the invention, openings or apertures are provided at spaced apart locations near the edge of the window pane, and pivot pins are inserted through the frame members to extend through corresponding ones of the openings. The thickness of the pivot pins is less than the dimension of the opening to allow movement therein so that the pivot pins hold the frame members onto the edges of the window pane and yet allow movement and pivoting of the frame members to accommodate variations in the dimensions of window frames into which the window structure may be placed. The window pane would typically be constructed of glass, acrylic resin, or other suitable transparent material.

BRIEF DESCRIPTION OF THE DRAWINGS

The above and other objects, features and advantages of the present invention will become apparent from a consideration of the following detailed description presented in connection with the accompanying drawings in which:

FIG. 1 is a perspective view of a window structure made in accordance with the present invention;

FIG. 2 is an exploded view of the window structure of FIG. 1; and

FIG. 3 is a cross-sectional view of one frame member and a portion of a window pane and spring element.

DETAILED DESCRIPTION

FIGS. 1 and 2 show respectively a perspective view and an exploded view of a window frame structure made in accordance with the present invention. The structure includes a generally rectangular, planar window pane 4 constructed of glass, acrylic resin, or other suitable transparent material. Located near each of the four edges of the window pane 4 are apertures 8. The apertures are positioned about midway along the length of each edge as shown.

Positioned over each of the edges of the window pane 4 are elongate frame members 12*a* through 12*d*, constructed of wood, plastic, or other fairly lightweight material. Each frame member 12 includes a slot, such as slot 16 of frame member 12*b*, which extends the length of the member on one side thereof and is dimensioned to receive a corresponding edge of the window pane 4.

Disposed in the slot of each frame member 12 is a wire spring element (20*a* through 20*d*). Each wire element is formed with a plurality of bends spaced apart along the length of the wire in a type of zig-zag fashion. That is, alternating ones of the bends face in one direction while the remaining bends face in the other direction so that the wire element generally lies in a plane. The wire elements 20 are positioned in the slots of a different one of the frame members 12 to contact the bottom wall of the slot and the edge of the window pane 4 to thereby urge the frame member outwardly from the window pane. The wire elements 20 provide resiliency or elasticity to urge the frame members outwardly by reason of the bends formed in the elements. This can be understood by visualizing frame member 12*d*, for example, of FIG. 2 being moved upwardly to receive the wire element 20*d* in the slot thereof and to engage the bottom edge of the window pane. As the frame member is pushed upwardly on the window pane 4, the bends in the wire element 20*d* are caused to flatten and as a result the wire element produces a reactive force to urge the frame member 12*d* downwardly.

Although a particular construction for the wire elements 20*a* through 20*d* has been shown and described, it is apparent that other spring biasing arrangements could be provided for urging the frame members 12*a* through 12*d* outwardly of the window pane 4. For example, an elongate rubber element could be disposed in the slots to provide a reactive force similar to that of the wire elements 20*a* through 20*d* .

Knobs 24*a* and 24*c* are secured on frame members 12*a* and 12*c* respectively to facilitate lifting and placement of the window structure in window frames. The knobs include pivot pins 28*a* and 28*b*, as shown in FIG. 2, which are insertable in openings 32 of frame members 12*a* and 12*c* to extend through corresponding openings 8 in the window pane 4. In other words, the pivot pins 28*a* and 28*b* extend through the frame members 12*a* and 12*c* and through corresponding openings 8 to thereby hold the frame members onto the window pane 4. Pivot pins 28*b* and 28*d* are also provided to hold frame members 12*b* and 12*d* onto the window pane 4. The diameter of the openings 8 is larger than the thickness of the pivot pins to enable movement of the pivot pins within the opening and thereby enable some movement and pivoting of the frame members to present variable exterior dimensions of the window structure. The value of this is so that the window structure may be fitted into a number of different window frames having periphery defining, inwardly facing walls which may vary in dimensions and shapes from window frame to window frame. The pivot pins 28 may simply be conventional nails. Illustratively, the apertures 8 are generally circular in shape having a diameter of about $\frac{3}{8}$ of an inch whereas the thickness of the pivot pins 28*a* through 28*d* might illustratively have a thickness of about 1/16 of an inch.

FIG. 3 shows a cross-sectional view of a frame member 12 and an edge portion 36 of a window pane inserted into a slot 40 formed in the frame member. A wire element 20 is disposed in the slot to contact the edge of the window pane 36 and a bottom wall 44 of the slot 40. When the window pane 36 is forced against the wire element 20, it causes the wire element to compress and react against the window pane thereby forcing the frame member 12 upwardly. A knob 24 is shown mounted on the frame member 12, with a pin 28 of the knob extending through the frame member and through an opening in the window pane 36.

With the configuration described, the frame members 12*a* through 12*d* are urged outwardly of the pane 4 to contact and secure in place the described window structure when placed in a conventional window frame having inwardly facing walls. To position the window structure in the frame, the frame members are urged inwardly against the window pane to reduce the peripheral dimension of the structure and allow placement thereof in the window frame. Release of the frame members allows the wire elements 20 to force corresponding frame members outwardly from the window pane 4 to contact the periphery defining walls of the window frame and secure the window structure in place.

Illustratively, the window pane would be constructed of acrylic resin having a thickness of about 0.08 inches. The depth of the slots shown in FIG. 3 might illustratively be about $\frac{7}{8}$ of an inch deep with the wire element 20 occupying about $\frac{1}{4}$ of an inch of the depth of the slot and the window pane 36 occupying about $\frac{5}{8}$ of an inch of the slot. Advantageously, the wire element 20 is constructed of an oil tempered spring wire or similar wire.

The particular arrangement of frame members 12*a* through 12*d* of FIG. 1 has been found to be especially advantageous. This arrangement provides for positioning the bottom frame member 12*d* about the bottom edge of the window pane 4, and the side frame members 24*a* and 24*c* over the side edges of the window pane to overlap the ends of the frame member 12*d*. Then, the top frame member 12*b* is positioned over the top edge of the window pane 4 to overlap the upper ends of the frame members 12*a* and 12*c* as shown. The top frame member 12*b* is thus supported in this configuration while the window structure is being placed in a window frame.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A window structure adapted for placement in and removal from a window frame which has a periphery defining wall, said window structure including,
   - a generally planar window pane constructed of a transparent material such as glass, acrylic resin, or the like, said window pane including a plurality of openings located at spaced apart locations near the edges of the window pane,
   - a plurality of frame members, each having an elongate slot in one side thereof extending substantially the length of the member, such slot being of a size sufficient to receive a portion of the edge of said window pane,
   - a plurality of spring biasing means, each disposed in a slot of a different one of said frame members for acting against said window pane edge to urge the frame member outwardly of the window pane and against the periphery defining wall when the window structure is placed in the window frame, and
   - a plurality of pivot pins each of which is insertable in a different one of said frame members to extend through the slot of the corresponding frame member and through a corresponding one of said openings in the window pane to thereby serve as a pivot for said frame members.

2. A window structure as in claim 1 wherein the openings in said window pane are generally circular having a diameter which is larger than the thickness of said pivot pins.

3. A window structure as in claim 1 further including a plurality of knobs attached to said frame members to project generally perpendicularly to the plane of said window pane.

4. A window structure adapted for removable placement in a generally rectangular frame having inward facing walls, said window structure including
   - a generally rectangular window pane, said window pane including four apertures each located near a different edge of the window pane about midway along the length of the edge,
   - four elongate frame members, each having a slot formed in one side thereof to extend longitudinally therealong for receiving an edge of said window pane,
   - four spring biasing means, each disposed in a different one of the slots for urging apart the corresponding frame member from the edge of the window pane to thereby force the frame member against one of the walls of the frame into which the window structure is placed, and
   - four pivot pins each of which is insertable in a different one of said frame members to extend through a corresponding one of said apertures in the window pane to thereby hold the frame members onto the window pane and to serve as a pivot for the frame members.

5. A window structure as in claim 4 wherein said apertures are generally circular having diameters of about $\frac{3}{8}$ of an inch, and wherein the thickness of said pivot pins is about 1/16 of an inch.

6. A window structure as in claim 4 wherein each of said spring biasing means is comprised of an elongate, resilient element formed with bends therealong to provide a reaction force when compressed, said element being disposed in a slot of a corresponding frame member.

7. A window structure as in claim 6 wherein said bends are formed in the elements so that the elements present a zig-zag appearance.

8. A window structure as in claim 7 wherein said bends are spaced apart about six inches from one another along the length of each element.

9. A window structure as in claim 7 wherein said resilient elements are constructed of oil tempered wire.

10. A window structure as in claim 7 wherein the height of said bends is about $\frac{1}{4}$ of an inch.

* * * * *